United States Patent [19]

Sugasawa et al.

[11] 4,308,831

[45] Jan. 5, 1982

[54] INTERNAL COMBUSTION ENGINE

[75] Inventors: Fukashi Sugasawa, Yokohama; Haruhiko Iizuka, Yokosuka, both of Japan

[73] Assignee: Nissan Motor Company, Limited, Yokohama, Japan

[21] Appl. No.: 90,052

[22] Filed: Oct. 31, 1979

[30] Foreign Application Priority Data

Dec. 12, 1978 [JP] Japan ..... 53-154004

[51] Int. Cl.[3] ..... F02D 17/02

[52] U.S. Cl. ..... 123/198 F; 123/568

[58] Field of Search ..... 123/198 F, 568

[56] References Cited

U.S. PATENT DOCUMENTS

| | | | |
|---|---|---|---|
| 4,171,689 | 10/1979 | Ehelm | 123/568 |
| 4,192,278 | 3/1980 | Iizuka et al. | 123/198 F |
| 4,201,180 | 5/1980 | Iizuka | 123/198 F |
| 4,224,920 | 9/1980 | Sugasawa et al. | 123/198 F |
| 4,231,338 | 11/1980 | Sugasawa et al. | 123/198 F |

FOREIGN PATENT DOCUMENTS

| | | | |
|---|---|---|---|
| 616204 | 6/1935 | Fed. Rep. of Germany . | |
| 2900953 | 7/1979 | Fed. Rep. of Germany . | |
| 5289520 | 12/1950 | Japan . | |
| 52111830 | 2/1951 | Japan . | |
| 5498422 | 1/1978 | Japan | 123/198 F |
| 397824 | 11/1931 | United Kingdom . | |
| 1480421 | 7/1977 | United Kingdom . | |
| 1505122 | 3/1978 | United Kingdom . | |
| 2012866 | 8/1979 | United Kingdom . | |

*Primary Examiner*—P. S. Lall

*Attorney, Agent, or Firm*—Schwartz, Jeffery, Schwaab, Mack, Blumenthal & Koch

[57] ABSTRACT

An internal combustion engine is disclosed which comprises a plurality of cylinders split into first and second groups, an intake passage provided therein with a throttle valve and divided downstream of the throttle valve into first and second branches, the first branch leading to the first group of cylinders, the second branch leading to the second group of cylinders, an EGR passage bypassing the second group of cylinders, an EGR valve provided in the EGR passage for allowing re-introduction of exhaust gases through the EGR passage into the second group of cylinders when the engine is under low load conditions, a check valve provided in the second branch of the intake passage, and the check valve adapted to allow air to flow from the intake passage into the second branch but to prevent exhaust gases from flowing from the second branch into the intake passage.

3 Claims, 5 Drawing Figures

INTERNAL COMBUSTION ENGINE

BACKGROUND OF THE INVENTION

1. Field of the Invention

This invention relates to an internal combustion engine of the type including a plurality of cylinders split into first and second groups and adapted to operate in a split cylinder mode with the first group of cylinders held operative and the second group of cylinders suspended when the engine is under low load conditions and in a full cylinder mode with both of the first and second groups of cylinders held operative when the engine is under high load conditions. The invention is more particularly concerned with means for use in such an engine for preventing exhaust gases recirculated in a second branch of the intake passage leading to the second group of cylinders from flowing therefrom into a first branch of the intake passage leading to the first group of cylinders when the engine is shifted from a split cylinder mode to a full cylinder mode.

2. Description of the Prior Art

It is well known that when an engine is operating under a higher load condition, its fuel combustion and fuel economy becomes higher. In view of this fact, split operation control systems have already been proposed for use in multicylinder internal combustion engines such as automotive vehicle engines and the like subject to frequent load variations. Such a system is responsive to engine low load conditions for cutting off the supply of fuel to some of the cylinders of the engine so as to hold them thereby maintaining the load of each of the other operating cylinders above a predetermined level and attaining high fuel economy.

Assuming that such a split operation control system is applied to a 6-cylinder internal combustion engine for cutting off the supply of fuel and fresh air to three cylinders of the engine so as to suspend them when the engine is under low load conditions, air will be discharged from the suspended cylinders and mixed with exhaust gases discharged from the other three operating cylinders, which results in a reduction of temperature of exhaust gases passing through a three-way catalyzer provided in its exhaust system, causing poor exhaust emission purifying performance thereof and also which results in inaccurate air-fuel ratio feedback control made by an oxygen sensor provided in the exhaust system, causing poor fuel economy.

In order to eliminate these disadvantages, a split-type internal combustion engine has been proposed which includes a plurality of cylinders split into first and second groups, an intake passage provided therein with a throttle valve and divided downstream of the throttle valve into first and second branches, the first branch leading to the first group of cylinders, the second branch leading to the second group of cylinders, the second branch provided at its entrance with a stop valve adapted to close so as to prevent air from flowing into the second group of cylinders when the engine is under low load conditions, and an exhaust gas recirculation passage for re-introduction of exhaust gases into the second group of cylinders so as to reduce the vacuum appearing in the suspended cylinders thereby reducing pumping loss therein.

One difficulty with such a split-type internal combustion engine is that exhaust gases recirculated and charged in the second branch of the intake passage flow through the stop valve into the first branch thereof so as to cause unstable fuel combustion in the first group of cylinders at the moment when the engine is shifted from a split cylinder mode to a full cylinder mode. This results in poor engine performance and poor driving feel.

SUMMARY OF THE INVENTION

It is therefore one object of the present invention to provide an improved split-type internal combustion engine which is free from unstable fuel combustion and poor driving feel having occurred in conventional split-type engines when the engine is shifted from its split cylinder mode to its full cylinder mode.

According to the present invention, this and other objects are accomplished by an internal combustion engine comprising a plurality of cylinders split into first and second groups, an intake passage provided therein with a throttle valve and divided downstream of the throttle valve into first and second branches, the first branch leading to the first group of cylinders, the second branch leading to the second group of cylinders, an EGR passage bypassing the second group of cylinders, an EGR valve provided in the EGR passage for allowing re-introduction of exhaust gases through the EGR passage into the second group of cylinders when the engine is under low load conditions, a check valve provided in the second branch of the intake passage, and the check valve adapted to allow air to flow from the intake passage into the second branch but to prevent exhaust gases from flowing from the second branch into the intake passage.

Other objects, means, and advantages of the present invention will become apparent to one skilled in the art thereof from the following description.

BRIEF DESCRIPTION OF THE DRAWINGS

The following explanation of the preferred embodiments of the present invention will help in the understanding thereof, when taken in conjunction with the accompanying drawings, which, however, should not be taken as limiting the present invention in any way, but which are given for purposes of illustration only. In the drawings, like parts are denoted by like reference numerals, and.

DESCRIPTION OF THE PREFERRED EMBODIMENTS

Figure 1:
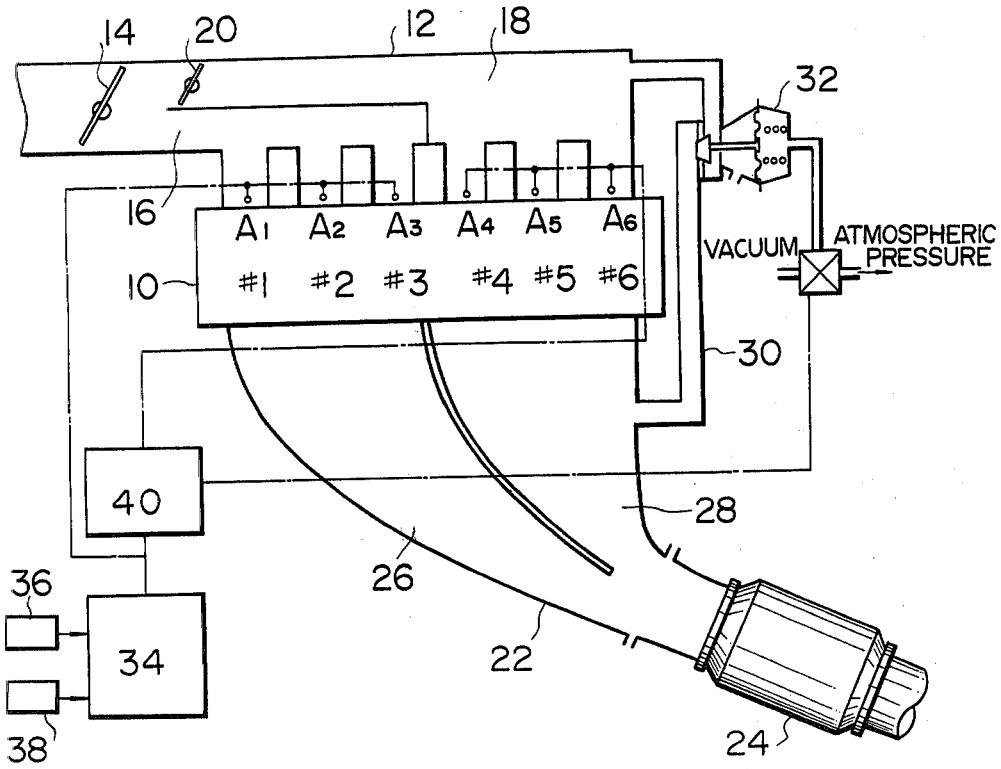
FIG. 1 is a schematic sectional view showing a conventional split-type internal combustion engine.

Referring now to FIG. 1, there is illustrated a 6-cylinder split-type internal combustion engine which comprises an engine body 10 having a plurality of cylinders split into first and second groups, each of the cylinders fitted with a fuel injection valve A, an intake passage 12 provided therein with a throttle valve 14 and divided downstream of the throttle valve 14 into first and second branches 16 and 18, the first branch 16 leading to the first group of cylinders #1 to #3, the second branch 18 leading to the second group of cylinders #4 to #6, the second branch 18 provided at its entrance with a stop valve 20, an exhaust passage 22 provided at its downstream end with a catalyzer 24 such as a three-way catalyzer, the exhaust passage 22 divided upstream of the catalyzer 24 into first and second branches 26 and 28, the first branch 26 communicating with the first group of cylinders #1 to #3, the second branch 28 communicating with the second group of cylinders #4 to #6, an exhaust gas recirculation (EGR) passage 30 opened at its one end into the second branch 28 of the exhaust passage 22 and opened at the other end to the second branch 18 of the intake passage 12, and an EGR valve 32 provided in the EGR passage 30.

When the engine is under low load conditions, the engine operates in its split cylinder mode. That is, the valve 20 closes so as to cut off flow of fresh air through the second branch 18 to the second group of cylinders #4 to #6 and the fuel injection valves A4 to A6 close so as to stop injection of fuel into the second group of cylinders #4 to #6, whereby the second group of cylinders #4 to #6 are held suspended. In addition, the EGR valve 32 opens to allow re-introduction of exhaust gases through the EGR passage 30 into the second branch 18 of the intake passage 12 so as to reduce the vacuum appearing therein thereby reducing pumping loss in the second group of cylinders #4 to #6.

The reference numeral 34 designates a fuel injection control circuit which is responsive to the outputs of an intake air flow sensor 36 and an engine speed sensor 38 for determining the amount of fuel injected through each fuel injection valve A into the corresponding cylinder and providing a fuel injection pulse signal directly to each of the fuel injection valves A1 to A3 and also through a control circuit 40 to each of the fuel injection valves A4 to A6. The control circuit 40 is responsive to engine low load conditions for cutting off the supply of injection pulse signals to the injection valves A4 to A6, closing the stop valve 20 to cut off the supply of fresh air into the second group of cylinders #4 to #6, and opening the EGR valve 32 to allow recirculation of exhaust gases into the second group of cylinders #4 to #6. The control circuit 40 may be designed to sense engine low load conditions in accordance with the pulse width of the injection pulse signals applied thereto from the fuel injection control circuit 40.

The stop and EGR valves 20 and 32 may be taken in the form of an electromagnetic valve responsive to a drive signal from the control circuit 40 for selectively passing vacuum or atmospheric pressure to the working chamber of the diaphragm operated valve.

In such a split-type internal combustion engine, during the split cylinder mode of operation, substantially the whole amount of exhaust gases discharged from the second group of cylinders #4 to #6 is recirculated thereinto without any cooled fresh air flowing through the exhaust passage 22. This permits high exhaust emission purifying performance of the catalyzer 24 and also accurate air-fuel ratio feedback control of the oxygen sensor provided in the exhaust passage 22 as made during a full cylinder mode of operation.

In spite of such great advantages, such a split-type internal combustion engine has had serious difficulties such as the tendency of exhaust gases recirculated into the second branch 18 of the intake passage 12 to flow through the stop valve 20 into the first branch 16 thereof so as to cause aggravation of fuel combustion in the first group of cylinders #1 to #3 at the moment when the engine is shifted from a split cylinder mode to a full cylinder mode. That is, during a split cylinder mode of operation, the EGR valve 32 opens so that substantially the whole amount of exhaust gases discharged from the second group of cylinders #4 to #6 will be recirculated into the second branch 18 of the intake passage 12 to maintain the vacuum therein at atmospheric level, whereas a vacuum corresponding to the opening of the throttle valve 14 appears in the first branch 16 of the intake passage 12. The difference between the pressures appearing in the first and second branches 16 and 18 of the intake passage 12 causes flow of exhaust gases through the stop valve 20 from the second branch 18 to the first branch 16.

Although when the engine is shifted to its full cylinder mode of operation, the EGR valve 32 closes and the vacuum in the second branch 18 becomes high, the exhaust gases charged in the second branch 18 will flow through the stop valve 20 into the first branch 16 at the moment when the engine is shifted to the full cylinder mode, so that the mixtures produced in the first group of cylinders become in considerable excess of exhaust gases, causing poor fuel combustion and poor engine performance.

Even if, instead of exhaust gases, air flows from the second branch 18 into the first branch 16 when the engine is shifted from its split cylinder mode to its full cylinder mode, the air flows into the first group of cylinders to rarefy the mixtures produced in the first group of cylinders, causing unstable fuel combustion. Such mixture rarefaction causes poor driving feel at the moment when the engine is shifted to the full cylinder mode of operation particularly where the accelerator pedal is rapidly depressed to make acceleration during engine low load conditions.

The first combustion in the second group of cylinders #4 to #6 just after fuel injections are started again through the fuel injection valves A4 to A6 thereinto are made with mixtures including a great amount of exhaust gases and thus the fuel combustions are relatively poor. However, such unstable fuel combustions in the second group of cylinders having been suspended has a disregardable effect on the performance of the engine as compared to those in the first group of cylinders having operated.

Although in order to prevent exhaust gases from flowing through the stop valve 20 from the first branch 18 into the first branch 16, an attempt may be considered to maintain the vacuum in the second branch 18 higher than that in the first branch 16, this remarkably degrades the previously stated pumping loss reduction effect.

Figure 2:
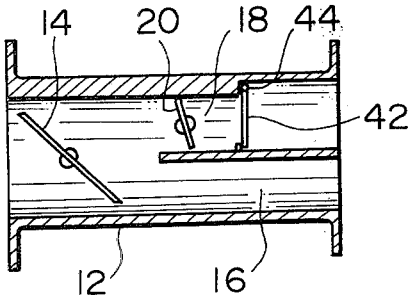
FIG. 2 is an enlarged sectional view showing the significant portion of the intake passage of the present invention.

Referring to FIG. 2, there is illustrated one embodiment of the present invention in which a check valve 42 is provided in the second branch 18 of the intake passage 12 downstream of the stop valve 20 for preventing exhaust gases charged in the second branch 18 from flowing into the first branch 16 when the engine is shifted from its split cylinder mode to its full cylinder mode. The check valve 42 is adapted to open when pushed by air flowing from the intake passage 12 into the second branch 18 but to prevent flow of exhaust gases from the second branch 18 into the intake passage 12.

Figure 3:
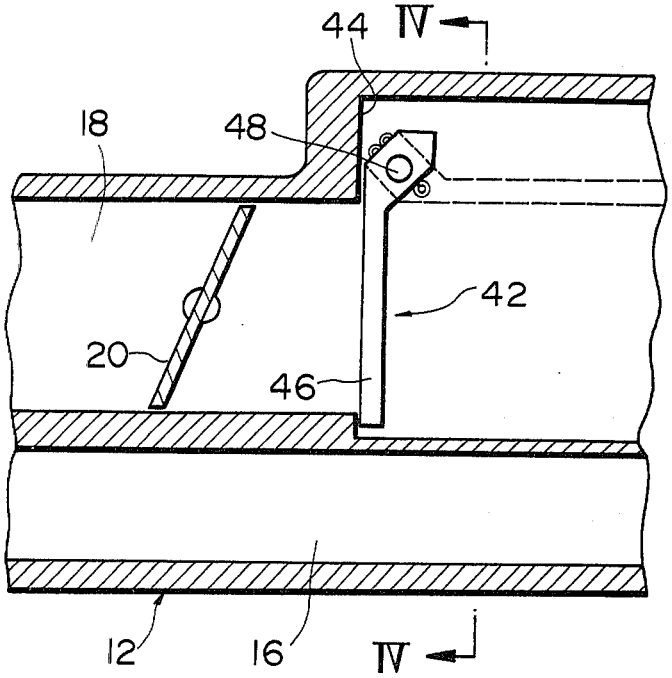
FIG. 3 is a longitudinal sectional view of the intake passage provided therein with a check valve.
Figure 4:
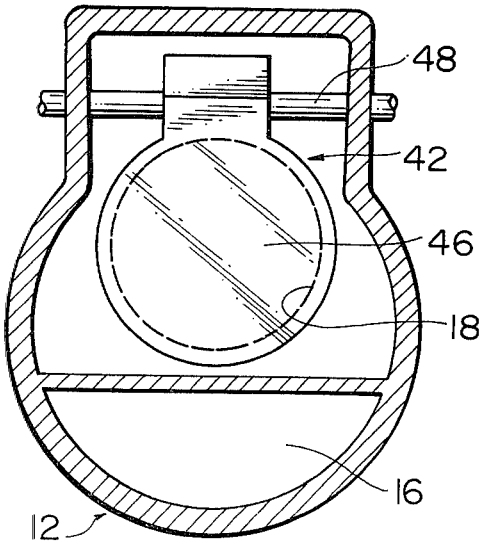
FIG. 4 is a transverse sectional view taken along the line IV—IV of FIG. 4.

Referring to FIGS. 3 and 4, the second branch is stepped at 44 to have its downstream portion incleased in diameter downstream of the stop valve 20. The check valve 42 has a disc-shaped valve plate 46 rotatably mounted on a shaft transversely extending within the large diameter portion of the second branch 18 such that the valve plate 46 opens the small diameter portion thereof when pushed by air flowing from the small diameter portion to the large diameter portion but closes the small diameter portion so as to prevent exhaust gases charged in the second branch 18 from flowing from the large diameter portion to the small diameter portion.

During a full cylinder mode of operation, the check valve 42 opens to allow air to enter the second group of cylinders #4 to #6 so that smooth full cylinder mode of operation can be assured. During a split cylinder mode of operation, the check valve 42 closes to prevent exhaust gases from flowing from the second branch 18 into the first branch 16 even if the vacuum in the second branch 18 upstream of the check valve 42 is relatively low due to closing of the stop valve 20 since the pressure in the second branch 18 downstream of the check valve 42 is substantially at atmospheric level.

The provision of the stop valve 20 and the check valve 42 in the second branch 18 of the intake passage 12 can eliminate the possibility of leakage of exhaust gases into the first branch, which is found in a split-type internal combustion engine having the second branch 18 provided with only the stop valve 20. This results in higher fuel combustion stability during a split cylinder mode of operation.

When the engine is shifted from its split cylinder mode to its full cylinder mode, i.e., when the stop valve 20 opens and the vacuum in the first branch effects or appears in the second branch 18, the check valve 42 is held closed due to the difference between the pressures applied on the opposite sides of the check valve 42. Thus, it is possible for the check valve 42 to prevent exhaust gases charged in the second branch 18 into the first branch 16 at the moment when the engine is shifted from its split cylinder mode to its full cylinder mode. Simultaneously, the EGR valve 32 closes so that the vacuum of the second branch 18 increases. When the vacuum in the second branch 18 becomes substantially equal to that of the first branch 16, the check valve 42 opens to allow air to enter the second group of cylinders.

Figure 5:
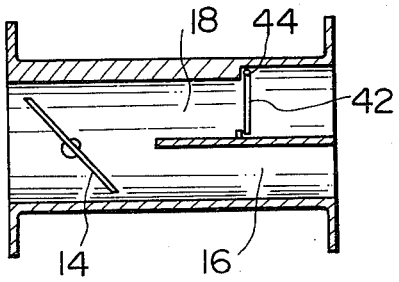
FIG. 5 is an enlarged sectional view showing the significant portion of the intake system of the present invention with the stop valve removed.

Referring to FIG. 5, there is illustrated a second embodiment of the present invention. This embodiment is substantially similar to the first embodiment except that the stop valve 20 is removed. If the vacuum in the second branch 18 is always held lower than the vacuum in the first branch 16 during a split cylinder mode of operation, different pressures excert on the opposite sides of the check valve 42 to maintain the check valve 42 closed so as to cut off the flow of air into the second branch 18. This eliminates the need for the stop valve 20. For this purpose, a great amount (substantially the whole amount) of exhaust gases discharged from the second group of cylinders #4 to #6 is re-introduced into the second branch 18 so as to hold the pressure in the second branch 18 substantially at atmospheric level. Thus, the EGR passage 30 and the EGR valve 32 should be designed to allow recirculation of the whole amount of exhaust gases discharged therefrom since if the vacuum in the second branch 18 becomes higher than the vacuum in the first branch 16, the check valve 42 opens so that fresh air will flow from the first branch 16 into the second branch 18. This embodiment permits removal of the stop valve 20, resulting in a simple intake passage structure.

There has been provided, in accordance with the present invention, is an improved split-type internal combustion engine in which exhaust gases can be prevented from flowing from cylinders having suspended into cylinders having operated to provided smooth driving and accelerating performance of the engine at the moment when the engine is shifted from its split cylinder mode to its full cylinder mode.

What is claimed is:

1. An internal combustion engine comprising:

(a) first and second cylinder units each including at least one cylinder;

(b) an intake passage provided therein with a throttle valve and divided downstream of said throttle valve into first and second branches, said first branch leading to said first cylinder unit, said second branch leading to said second cylinder unit;

(c) an exhaust passage for said first and second cylinder units;

(d) a check valve provided in said intake passage second branch, said check valve being operable in response to a pressure differential between opposite sides thereof for opening only when the pressure on the upstream side thereof is higher than the pressure on the downstream side thereof;

(e) an EGR passage having one end opening into said exhaust passage and another end thereof opening into said intake passage second branch downstream of said check valve;

(f) an EGR valve provided in said EGR passage; and (g) means, responsive to low engine load conditions, for disabling said second cylinder unit and opening said EGR valve to permit recirculation of exhaust gases into said intake passage second branch.

2. An internal combustion engine according to claim 1, which further comprises a stop valve provided in said second branch upstream of said check valve, and wherein said means closes said stop valve under low engine load conditions.

3. An internal combustion engine according to claim 1 or 2, wherein said intake passage second branch is stepped to have its downstream portion increased in diameter, and wherein said check valve comprises a valve plate pivotally mounted within said large diameter portion of said intake passage second branch to permit the flow of air into said second cylinder unit.

* * * * *